US011137200B2

(12) United States Patent
Kang et al.

(10) Patent No.: US 11,137,200 B2
(45) Date of Patent: Oct. 5, 2021

(54) REFRIGERATOR

(71) Applicant: SAMSUNG ELECTRONICS CO., LTD., Suwon-si (KR)

(72) Inventors: Chang Gu Kang, Suwon-si (KR); Chun Youp Shin, Suwon-si (KR); Kun Eui Hong, Suwon-si (KR); Ki Hak Hong, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 0 days.

(21) Appl. No.: 16/747,949

(22) Filed: Jan. 21, 2020

(65) Prior Publication Data

US 2020/0232700 A1 Jul. 23, 2020

(30) Foreign Application Priority Data

Jan. 21, 2019 (KR) ..... 10-2019-0007725

(51) Int. Cl.
*F25D 23/06* (2006.01)

(52) U.S. Cl.
CPC ..... *F25D 23/069* (2013.01); *F25D 23/062* (2013.01); *F25D 23/067* (2013.01); *F25D 2201/12* (2013.01)

(58) Field of Classification Search
CPC .... F25D 23/062; F25D 23/067; F25D 23/069; F25D 2201/12
See application file for complete search history.

(56) References Cited

U.S. PATENT DOCUMENTS 5,720,185 A * 2/1998 Lee ..... A47F 3/0408 62/408
6,044,654 A * 4/2000 Igari ..... F25D 17/065 236/49.3
2005/0235682 A1* 10/2005 Hirai ..... F25D 23/062 62/440
2012/0011879 A1* 1/2012 Gu ..... F25D 17/04 62/408
2017/0159995 A1* 6/2017 Allo ..... B29B 11/12
2017/0160001 A1* 6/2017 Deka ..... F25D 23/068
2018/0202701 A1* 7/2018 Kim ..... F25D 23/00
2018/0283071 A1* 10/2018 Choi ..... E05F 1/16

FOREIGN PATENT DOCUMENTS

JP 2001-74351 A 3/2001
JP 2001-108359 4/2001
JP 2014-173801 A 9/2014
(Continued)

OTHER PUBLICATIONS

English translation of Nakajima (JP2001074351) (Year: 2021).*
(Continued)

*Primary Examiner* — Matthew W Ing
(74) *Attorney, Agent, or Firm* — Staas & Halsey, LLP

(57) ABSTRACT

Provided is a refrigerator including a storeroom, an inner casing including a first plate to define the storeroom, a partition coupled to the first plate to divide the storeroom into multiple storerooms, and a bracket arranged on the first plate to couple the partition to the first plate, wherein the first plate includes a plurality of holes formed at a location corresponding to a location where the bracket is coupled to the first plate.

20 Claims, 10 Drawing Sheets

(56) References Cited

FOREIGN PATENT DOCUMENTS

| | | | | |
|---|---|---|---|---|
| KR | 20-1998-067373 | U | 12/1998 | |
| KR | 10-2008-0035093 | A | 4/2008 | |
| KR | 10-2012-0006699 | A | 1/2012 | |
| KR | 10-2017-0039628 | | 4/2017 | |
| WO | WO-2016013746 | A1 * | 1/2016 | ..... F25D 23/00 |

OTHER PUBLICATIONS

English translation of Jang (WO2016013746) (Year: 2021).*
International Search Report dated May 19, 2020, in corresponding International Patent Application No. PCT/KR2020/000871.

* cited by examiner

REFRIGERATOR

CROSS-REFERENCE TO RELATED APPLICATION

This application is based on and claims priority under 35 U. S. C. § 119 to Korean Patent Application No. 10-2019-0007725 filed on Jan. 21, 2019, the disclosure of which is incorporated herein by reference in its entirety.

BACKGROUND

1. Field of the Invention

The disclosure relates to a refrigerator, and more particularly, to a refrigerator including a plate of an inner casing to form a plurality of storerooms having different temperatures.

2. Discussion of Related Art

Refrigerators are home appliances defined by an outer casing and an inner casing and equipped with a cold air supplier for supplying cold air to a storeroom and a door for opening or closing the storeroom to keep food fresh. The storeroom is defined by the inner casing, and may have multiple storerooms maintained at different temperatures.

For aesthetic improvements, stainless steel inner casing of the refrigerator has recently been replacing acrylonitrile butadiene styrene copolymer (ABS) resin inner casing.

However, since the stainless steel has high heat conductivity, when a single stainless steel plate serves as one wall for a plurality of storerooms required to be maintained at different temperatures, a heat transfer may occur on the surface of the stainless steel plate corresponding to a border between the storerooms.

Especially, in the border between a storeroom maintained at a low temperature and a storeroom maintained at a relatively high temperature, a heat transfer occurs between the storerooms of the different temperatures, so that a temperature drop may occur on the surface of the inner casing corresponding to the border area of the high temperature storeroom, causing dew condensation on the surface.

SUMMARY OF THE INVENTION

In accordance with an aspect of the disclosure, a refrigerator includes a storeroom; an inner casing including a first plate to define the storeroom; and a partition coupled to the first plate to divide the storeroom into multiple storerooms, wherein the first plate comprises a plurality of holes formed at a location corresponding to a location where the partition is coupled to the first plate, and at least some of the plurality of holes define a first row at a level in a vertical direction and at least some of the plurality of holes define a second row at another level in the vertical direction.

The partition may divide the storeroom into a plurality of storerooms in the vertical direction, and the plurality of storerooms may have respective side walls aligned in a direction defined by the first plate.

The first plate may include a metal material.

The inner casing may include a second plate arranged parallel to the first plate, and the first and second plates may not be connected to each other.

The first row may be located higher than the second row, and at least a portion of a hole on the first row and at least a portion of a hole on the second row may overlap each other in the vertical direction.

At least some of the plurality of holes may be arranged at a level in the vertical direction lower than the second row to define a third row, and a plurality of holes arranged in the second row may have a larger cross-section than a plurality of holes arranged in the first or third row.

The plurality of holes arranged in the first and third rows may be located to correspond to each other in the vertical direction, and the plurality of holes arranged in the second row may be located to overlap some of the plurality of holes arranged in the first and third rows in the vertical direction.

Some others of the plurality of holes may be arranged at a level in the vertical direction lower than the third row to define a fourth row.

The refrigerator may further include mid-spaces formed between a plurality of holes arranged in the first row in a horizontal direction, and a plurality of holes arranged in the second row may be located to correspond to the mid-spaces in the vertical direction.

The refrigerator may further include first and second mid-spaces formed between a plurality of holes arranged in the first and third rows, respectively, in a horizontal direction, and a plurality of holes arranged in the second row may be located to correspond to the first and second mid-spaces in the vertical direction.

The refrigerator may further include a bracket arranged on the first plate to couple the partition to the first plate, and the plurality of holes may be arranged within the bracket in the vertical direction.

The refrigerator may further include an outer casing coupled onto an outer side of the inner casing to define an exterior, and an insulation filling in between the inner casing and the outer casing, and the inner casing may further include a cover member attached onto an outer side of the first plate to cover the plurality of holes in order to prevent the insulation from leaking out into the storeroom through the plurality of holes during filling of the insulation.

The refrigerator may further include an outer casing coupled onto an outer side of the inner casing to define an exterior, and an insulation filling in between the inner casing and the outer casing, and the insulation may flow from outside of the inner casing to the plurality of holes and fills in the plurality of holes.

The refrigerator may further include an outer casing coupled onto an outer side of the inner casing to define an exterior, and an insulation filling in between the inner casing and the outer casing, and the plurality of holes may be filled with an auxiliary insulation.

The refrigerator may further include a first duct arranged on a rear side of the storeroom for supplying cold air produced by a first evaporator to the storeroom and a second duct arranged to be lower than the first duct for supplying cold air produced by a second evaporator to the storeroom, and the partition may divide the storeroom into a first storeroom corresponding to the first duct and a second storeroom corresponding to the second duct.

In accordance with another aspect of the disclosure, a refrigerator includes a storeroom; an inner casing comprising a first wall to define a first side of the storeroom and include a a metal material; an outer casing coupled onto an outer side of the inner casing to define an exterior; an insulation filling in between the inner casing and the outer casing; and a partition coupled to the first wall to divide the storeroom into multiple storerooms, wherein the first wall comprises a buffer section formed at a location corresponding to a combined location of the partition and including a plurality of holes.

The partition may divide the storeroom into a first storeroom and a second storeroom kept at a lower temperature than the first storeroom, and the buffer section may include a transfer area located outside the plurality of holes to transfer cold air of the second storeroom to the first storeroom, and the plurality of holes may be arranged such that the transfer area vertically extends non-straight from top to bottom of the buffer section.

The plurality of holes may be arranged horizontally in a first row, a second row located below the first row, and a third row located below the second row, such that heat in the transfer area is transferred along a winding path bent at least two times in the vertical direction.

In accordance with another aspect of the disclosure, a refrigerator includes a first storeroom and a second storeroom kept at a lower temperature than the first storeroom; a single plate defining a wall of the first storeroom and a wall of the second storeroom; and a partition detachably coupled to the plate to separate the first and second storerooms, wherein the plate comprises a buffer section formed at a location corresponding to a combined location of the partition and including a plurality of holes.

The buffer section may be formed for a temperature of the second storeroom to be shifted non-straight to the first storeroom.

BRIEF DESCRIPTION OF THE DRAWINGS

The above and other objects, features and advantages of the present disclosure will become more apparent to those of ordinary skill in the art by describing in detail exemplary embodiments thereof with reference to the accompanying drawings, in which.

DETAILED DESCRIPTION OF EXEMPLARY EMBODIMENTS

Figure 1:
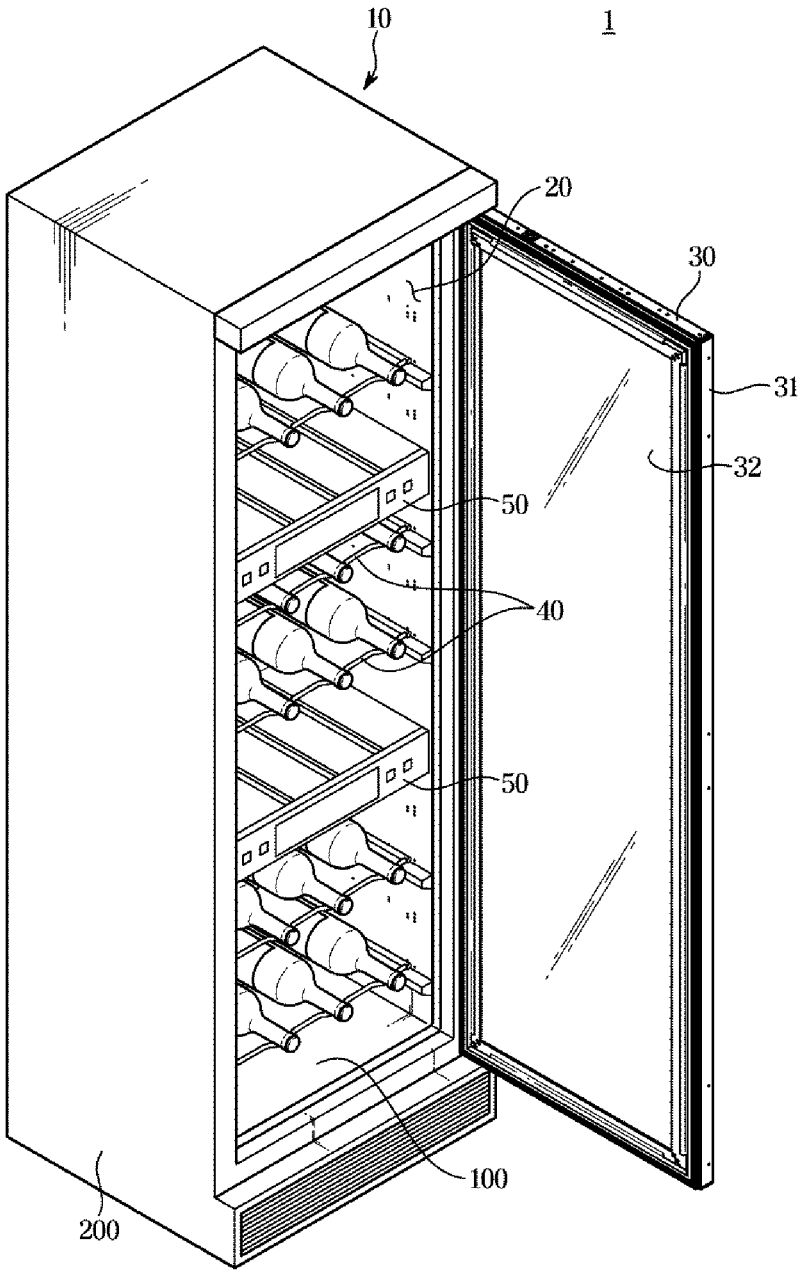
FIG. 1 is a perspective view of a refrigerator, according to an embodiment of the disclosure.

Embodiments and features as described and illustrated in the disclosure are merely examples, and there may be various modifications replacing the embodiments and drawings at the time of filing this application.

Throughout the drawings, like reference numerals refer to like parts or components.

The terminology used herein is for the purpose of describing particular embodiments only and is not intended to limit the disclosure. It is to be understood that the singular forms "a," "an," and "the" include plural references unless the context clearly dictates otherwise. It will be further understood that the terms "comprise" and/or "comprising," when used in this specification, specify the presence of stated features, integers, steps, operations, elements, and/or components, but do not preclude the presence or addition of one or more other features, integers, steps, operations, elements, components, and/or groups thereof.

The terms including ordinal numbers like "first" and "second" may be used to explain various components, but the components are not limited by the terms. The terms are only for the purpose of distinguishing a component from another. For example, a first element could be termed a second element without departing from the scope of the disclosure.

Reference will now be made in detail to embodiments of the disclosure, examples of which are illustrated in the accompanying drawings, wherein like reference numerals refer to the like elements throughout. The terms "front", "rear", "upper", "lower", "top", and "bottom" as herein used are defined with respect to the drawings, but the terms may not restrict the shape and position of the respective components.

A wine refrigerator to keep wine bottles at lower temperature will be taken as an example of a refrigerator in the following description. Embodiments of the disclosure as will be described below, however, are not limited to the wine refrigerator but may be equally applied to an ordinary refrigerator that stores various foods.

Figure 2:
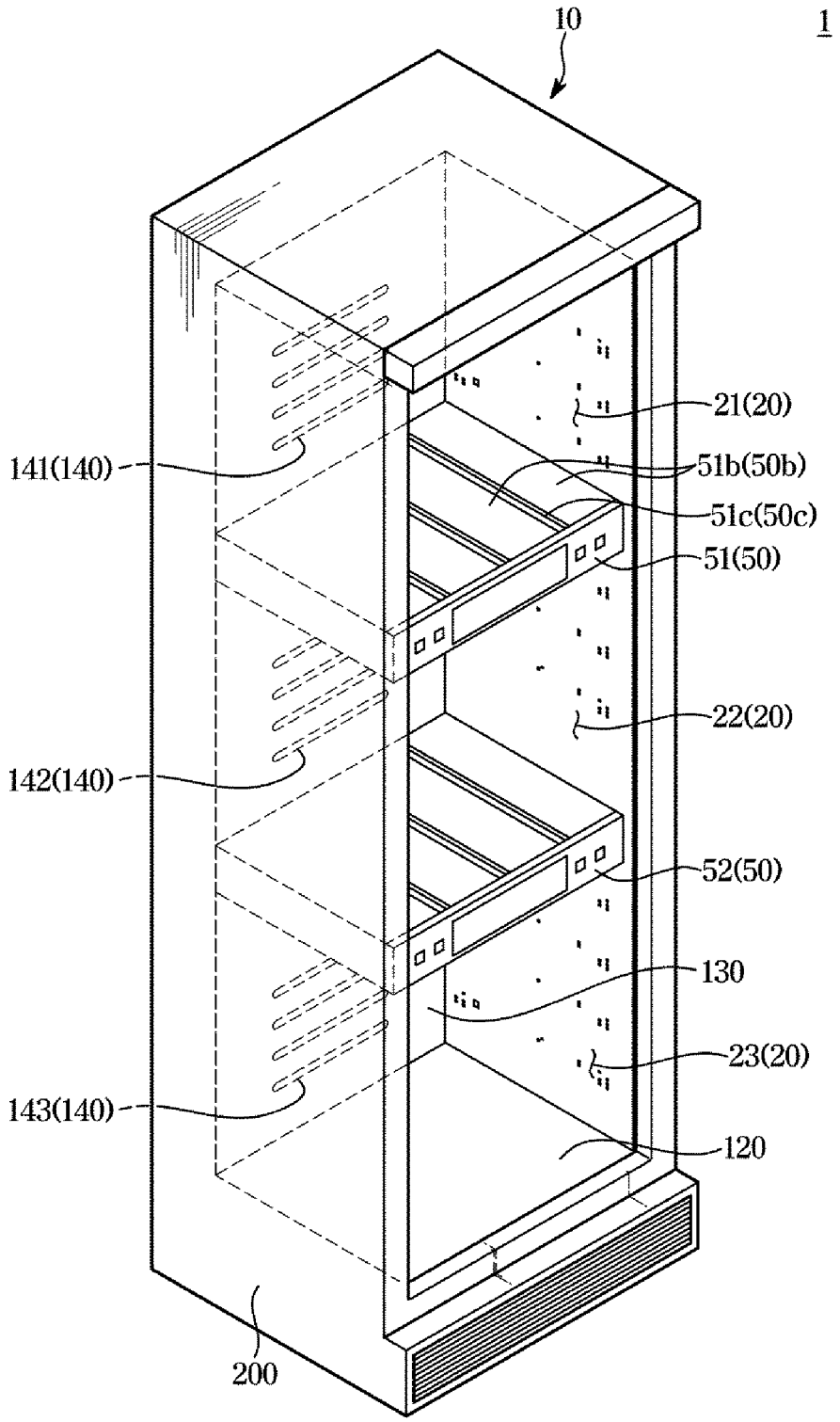
FIG. 2 shows a refrigerator including an inner casing, an outer casing, and partitions, according to an embodiment of the disclosure.
Figure 3:
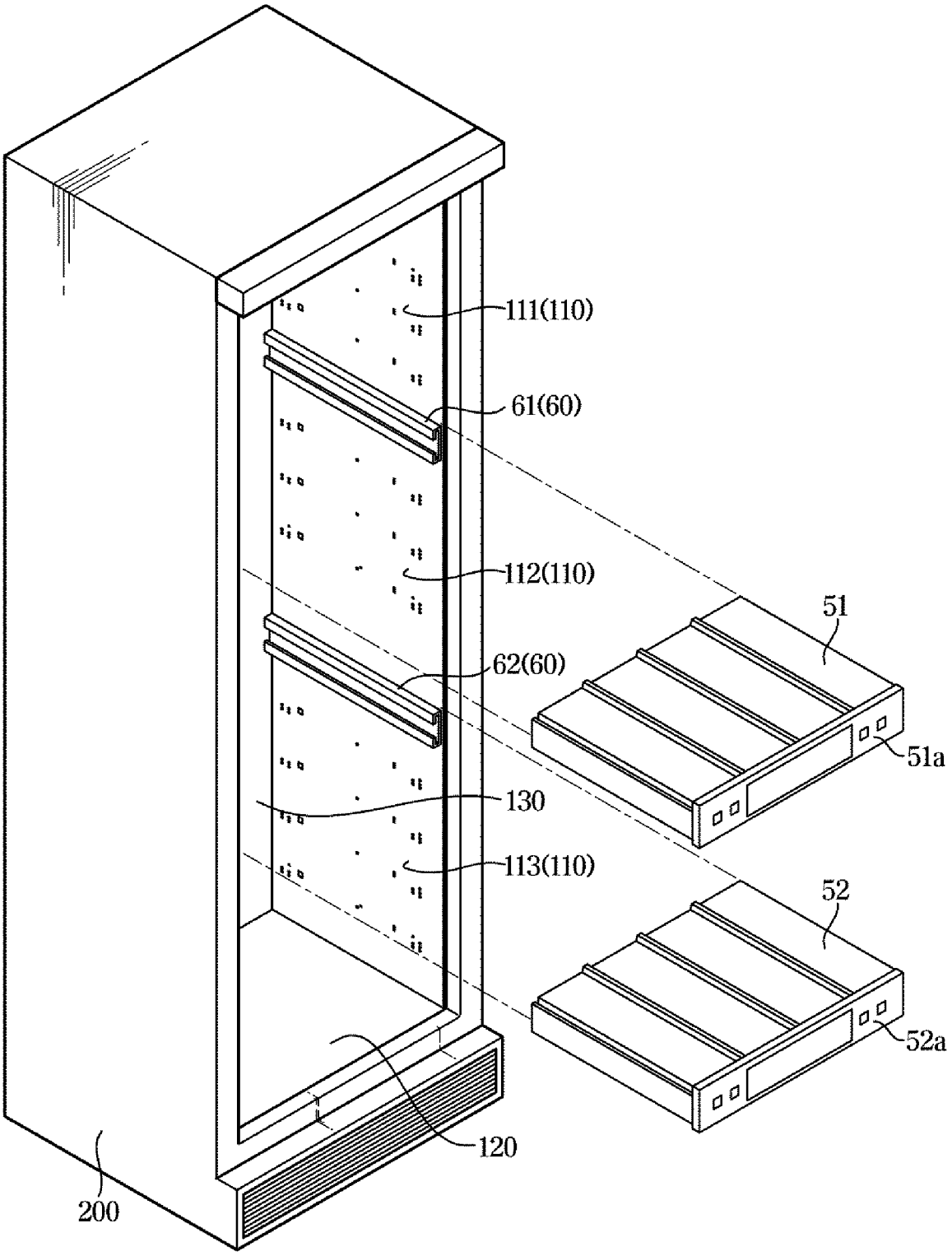
FIG. 3 shows the partitions separated from the refrigerator of FIG. 2.
Figure 4:
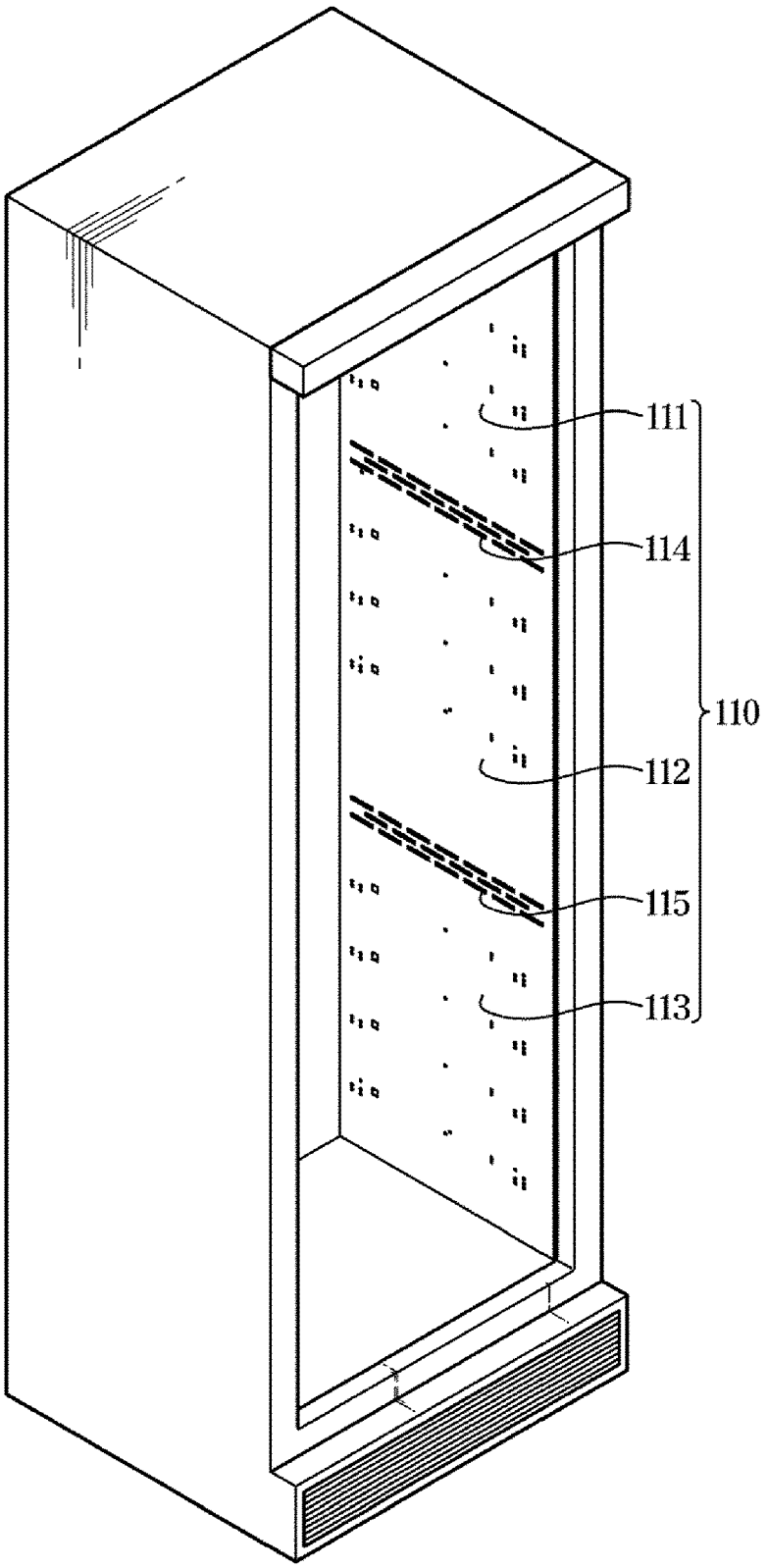
FIG. 4 shows the inner casing with brackets separated from the refrigerator of FIG. 3.

FIG. 1 is a perspective view of a refrigerator, according to an embodiment of the disclosure, FIG. 2 shows a refrigerator including an inner casing, an outer casing, and partitions, according to an embodiment of the disclosure, FIG. 3 shows the partitions separated from the refrigerator of FIG. 2, and FIG. 4 shows the inner casing with brackets separated from the refrigerator of FIG. 3.

Referring to FIGS. 1 and 2, a wine refrigerator 1 includes a main body 10 having a storeroom 20, and a door 30 for opening or closing the storeroom 20.

The main body 10 having the form of a rectangular box with open front may define the storeroom 20, and there may be a plurality of shelves 40 arranged in the storeroom 20 to put wine bottles thereon.

The main body 10 may include an outer casing 200 that defines the exterior of the main body 10, and an inner casing 100 arranged inside of the outer casing 200 to define the storeroom 20.

Insulation 210 may be foamed between the inner casing 100 and the outer casing 200.

The storeroom 20 may be formed by the inner casing 100. The storeroom 20 is the space formed by a total of five walls of the inner casing 100: a pair of side walls 110, a top wall (not shown), a bottom wall 120, and a rear wall 130.

The door 20 is pivotally installed on a front edge of the main body 10 to open or close the storeroom 20. The door 30 includes a door frame 31 shaped like a rectangular ring, and a transparent window 32 installed within the door frame 31. The user may check the inside of the storeroom 20 through the transparent window 32 from outside of the door 30.

The shelves 40 are wire racks formed by wires, so that air may pass up and down through the shelves 40 even while having wines put on the shelves 40.

The plurality of shelves 40 may be coupled to the storeroom 20 to be pulled forwards from the storeroom 20.

The plurality of shelves 40 may be detachably coupled to the storeroom 20. Accordingly, the user may install the plurality of shelves at preferred heights.

The wine refrigerator 1 may further include partitions 50 that divide the storeroom 20 into multiple ones 21, 22, and 22.

In an embodiment of the disclosure, the partitions 50 may include a first partition 51 and a second partition 52 to divide the storeroom 20 into first, second, and third storerooms 21, 22, and 23.

The partitions 50 may divide the storeroom 20 in the vertical direction. It is not, however, limited thereto. For example, the partitions 50 may be vertically installed in the storeroom 20 to divide the storeroom 20 in the horizontal direction.

As should be understood from the various figures, the vertical direction and the horizontal direction are directions with respect to a standing upright position of the refrigerator.

The partitions 50 may include first and second partitions 51 and 52 to divide the storeroom 20 into three storerooms 21, 22, and 23 in the vertical direction. It is not, however, limited thereto. For example, when the partition 50 may be provided in the singular, the partition 50 may divide the storeroom 20 into two in the vertical direction, or when there are three or more partitions 50, the partitions 50 may divide the storeroom 20 into four or more ones.

On the top of the partition 50, there may be a seat 50*b* for the wine to be seated therein and a guide projection 50*c* for preventing deviation of the wine seated in the seat 50*b* and guiding a wine to be seated in the seat 50*b*.

The first partition 51 may include the first seat 51*b* and the first guide projection 51*c*, and the second partition 52 may include the same structures.

The wine refrigerator 1 may further include brackets 60 provided to couple the partition 50 into the storeroom 20.

The brackets 60 may be formed in pairs to be combined with both ends of the partition 50. The number of brackets 60 may be two times greater than the number of partitions 50.

A pair of brackets 60 may be arranged on the pair of side walls 110 of the inner casing 100. The partitions 50 may be coupled by the pairs of brackets 60 to the inner casing 100. Specifically, a pair of brackets 60 may be coupled to the pair of side walls 110, i.e., to the left and right side walls 110, thereby dividing the storeroom 20 in the vertical direction.

For example, in an embodiment of the disclosure, the bracket 60 may include a pair of first brackets 61 combined with the first partition 51 and a pair of second brackets 62 combined with the second partition 52.

Each of the pair of first brackets 61 and the pair of second brackets 62 may be coupled to the pair of side walls 110.

On one side wall 110, the first and second brackets 61 and 62 may be arranged in parallel in the vertical direction, and the first bracket 61 may be arranged higher than the second bracket 62 (see FIG. 3).

It is not, however, limited thereto. For example, when the partition 50 divides the storeroom 20 into left and right ones, the brackets 60 may be arranged on the top wall (not shown) and the bottom wall 120. The number of the brackets 60 may vary depending on the number of partitions 50.

As shown in FIG. 2, the storerooms 21, 22, and 23 separated by the partitions 50 may each include a duct 140 for supplying cold air to the storeroom 21, 22, or 23.

The duct 140 may be formed on the rear side of the rear wall 130 of the inner casing 100.

In an embodiment of the disclosure, as the wine refrigerator 1 has the first to third storerooms 21, 22, and 23 formed by the first and second partitions 51 and 52, the duct 140 may include first to third ducts 141, 142, and 143 corresponding to the respective storerooms 21, 22, and 23.

The ducts 141, 142, and 143 may be provided to supply cold air with different temperatures to the respective storerooms 21, 22.

The ducts 141, 142, and 143 may include respective evaporators (not shown) for producing cold air with different temperatures. Accordingly, the duct 140 may include a total of three evaporators, without being limited thereto.

For example, the ducts 141, 142, and 143 may share a single evaporator (not shown).

In this case, the ducts 141, 142, and 143 may distribute the cold air produced from the single evaporator into the respective storerooms 21, 22, and 23.

To maintain the respective temperatures set for the storerooms 21, 22, and 23, the ducts 141, 142, and 143 may control an amount of cold air flowing into the ducts 141, 142, and 143.

For example, when the user sets the first storeroom 21 to be kept at a lower temperature than for the second storeroom 22, the first duct 141 may bring more of the cold air produced by the evaporator into the first storeroom 21 than the second duct 142 does. Accordingly, the storerooms 21, 22, and 23 formed by dividing the storeroom 20 by the partitions 50 may be kept at different temperatures.

Different kinds of wines have differently recommended storage temperatures. For example, red wines have a recommended storage temperature of about 14 to 18 degrees Celsius, sparkling wines have about 6 to 10 degrees Celsius, and ice wines have about 4 to 8 degrees Celsius.

To keep the different kinds of wines in the single wine refrigerator 1, the storeroom 20 may be divided by the partitions 50 into the storerooms 21, 22, and 23, each maintaining a different recommended wine storage temperature.

For example, the first, second, and third storerooms 21, 22, and 23 may be maintained at about 4, 18, and 8 degrees Celsius, respectively.

In this case, the first storeroom 21 may store ice wines, the second storeroom 22 may store red wines, and the third storeroom 23 may store sparkling wines.

The respective temperatures of the storerooms 21, 22, and 23 may be controlled by control panels 51*a* and 52*a* arranged on the front of the partitions 51 and 52, respectively.

The first control panel 51*a* may send an electric signal to the first duct 141, or the first and second ducts 141 and 142 to control the temperature of the first storeroom 21, or the temperatures of the first and second storerooms 21 and 22.

The second control panel 52*a* may send an electric signal to the third duct 143, or the third and second ducts 143 and 142 to control the temperature of the third storeroom 23, or the temperatures of the third and second storerooms 23 and 22.

Furthermore, although not shown, there may be a controller provided to control the respective temperatures of the storerooms 21, 22, and 23 by sending electric signals to the duct 140.

The controller may send electric signals separate from those of the control panels 51*a* and 52*a* to the duct 140 to control the temperature of at least one of the storerooms 21, 22, and 23 or the entire storeroom 20.

Although not shown, the controller may be electrically coupled to a controller manipulation panel (not shown) arranged at one side of the main body 10 to allow the user to easily manipulate the controller on his/her own. As shown in FIG. 3, the partitions 50 may be combined with the brackets 60 to slide forward or backward.

On the rear side of the partition 50, there may be a connector (not shown) arranged to electrically connect the controller to the control panel 51*a* or 52*a*.

The connector may be coupled to a connection dock (not shown) formed on the rear wall 130 and connected to the controller, thereby connecting the control panels 51*a* and 52*a* to the controller.

When the partition 50 is combined with the bracket 60, the connector may connect the control panel 51*a* and 52*a* to the controller, allowing the user to control the temperature of each storeroom 21, 22, or 23 through the control panel 51*a* and 52*a*.

When the partition 50 is detached by being pulled forward, the connector may also be pulled forward along with the partition 50 and detached, and accordingly, the connector and the connection dock may be naturally disconnected from each other.

As needed by the user, the storeroom 20 of the wine refrigerator 1 may be provided as a single storeroom or divided into two or more storerooms. As described above, the partition 50 may be easily separated from the bracket 60, so the user may divide or use the storeroom 20 as a whole by combining the partition 50 with the bracket 60 or separating the partition 50 from the bracket 60 as needed by the user.

When the partition 50 is not coupled into the storeroom 20, the first, second and third ducts 141, 142, and 143 may be set to release cold air with the same temperature. In this case, the user may keep wines in the storeroom 20 provided as a single one.

When the first partition 51 alone is coupled into the storeroom 20, the second and third ducts 142 and 143 may be set to release the same temperature cold air. When the second partition 52 alone is provided in the storeroom 20, the first and second ducts 141 and 142 may be set to release the same temperature cold air. In this case, the user may keep wines in the storeroom 20 provided as two rooms.

As described above, the user may divide the storeroom 20 into one, two, or three, and set the divided storerooms to be kept at different temperatures. Of course, in some cases, the divided storerooms may be set to have the same temperature.

Most of old refrigerators use white Acrylonitrile-Butadiene-Styrene (ABS) resin to form the inner casing. Recent refrigerators, however, have shown a trend of forming the inner casing with more luxurious materials than the old ABS resin to improve aesthetic sense of the refrigerator.

Especially, using stainless steel for the inner casing of modern refrigerators is ever increasing.

In an embodiment of the disclosure, the wine refrigerator 1 may also have the inner casing 100 formed with stainless steel. It is not, however, limited thereto, and the inner casing 100 may be formed with silver metal.

For the wine refrigerator 1 according to an embodiment of the disclosure, each wall of the inner casing 100 may be formed of a stainless steel plate.

That is, the inner casing 100 of the wine refrigerator 1 may be formed of five stainless steel plates. The plates may be assembled into the inner casing 100.

It is not, however, limited thereto, and the inner casing 100 may be formed of a single stainless plate by bending the single stainless plate into five walls.

Alternatively, less than five stainless steel plates may be bent into five walls.

As described above, the storeroom 20 may be adjustably divided into the plurality of storerooms 21, 22, and 23 or may be formed in the single storeroom 20. When the storeroom 20 is divided into the plurality of storerooms 21, 22, and 23, a side wall of the plurality of storerooms 21, 22, and 23 may correspond to one side wall 110 of the inner casing 100.

For example, the side wall (corresponding to a first section 111, a second section, and a third section 113 as will be described later) of the plurality of storerooms 21, 22, and 23 separated by the at least one partition 51, 52 may be formed by one plate that corresponds to the one side wall 110 of the inner casing 100.

The plurality of storerooms 21, 22, and 23 may be kept at different temperatures. When there is a big difference in temperature between the first and second storerooms 21 and 22, or the second and third storerooms 22 and 23, each of the storerooms 21, 22, and 23 may transfer heat to another storeroom because the same plate constitutes the storerooms 21, 22, and 23.

Especially, as the stainless steel plate has high heat conductivity compared to the old ABS resin, heat is easily transferred from one storeroom 21, 22, or 23 to another along the stainless steel plate.

For example, when different temperatures of two of the storerooms 21, 22, and 23 mix in a border area between the two storerooms kept at the different temperatures through the stainless steel plate, temperature of a portion of the stainless steel plate in the storeroom with higher temperature near the border area may drop.

Hence, dew condensation may occur in the portion of the stainless steel in the storeroom with higher temperature near the border area, degrading credibility of the wine refrigerator 1. Specifically, as a surface temperature of the portion of the stainless steel plate in the storeroom with higher temperature drops, dew may be formed on the surface of the portion.

In general, heat is transferred from high temperature to low temperature, so when a high temperature area borders a low temperature area, heat is transferred from the high temperature area to the low temperature area until the high temperature area and the low temperature area reach a thermal equilibrium state.

In this case, as the high and low temperatures mix in the border area, a portion of the high temperature area near the low temperature area goes through a temporary drop of temperature due to the influence of the low temperature area.

In an embodiment of the disclosure, assuming that a high temperature area of a stainless steel plate is the first section 111 and a low temperature area of the stainless steel plate is the second section 112, the first duct 141 keeps supplying high temperature air and the second duct 141 keeps supplying low temperature air, so that the first and second sections 111 and 112 may have temperatures corresponding to those produced from the ducts 141 and 142, respectively, without reaching to the heat equilibrium state. In such a situation, a portion of the first section 111 near the second section 112 may go through a temporary drop of temperature due to the influence of the second section 112, causing dew condensation to occur in the portion.

In other words, as the separate storerooms 21, 22, and 23 all use the same stainless steel plate for their side wall, temperatures of the storerooms may mix in each border area, and the mixed heat may be transferred along the stainless steel plate, influencing the neighboring storerooms near the border area.

To avoid this problem, as shown in FIG. 4, the wine refrigerator 1 according to an embodiment of the disclosure may include buffer sections 114 and 117 for containing heat transfer to the storerooms 21, 22, and 23 in the border area between the storerooms.

Specifically, the stainless steel plate forming the side wall 110 of the inner casing 100 may include the buffer sections 114 and 117 provided at locations where the storerooms 21, 22, and 23 are separated.

As can be seen from FIGS. 1-4, first partition 51 may by coupled to side wall 110 by first bracket 61 so as to be over buffer section 114, and section partition 52 may be coupled to side wall 110 by second bracket 62 so as to be over buffer section 117.

The first side wall 110 may include the first section 111 forming a side wall of the first storeroom 21, the second section 112 forming a side wall of the second storeroom 22, and the third section 113 forming a side wall of the third storeroom 23.

The buffer sections 114 and 117 may be formed between the first and second sections 111 and 112 and between the second and third sections 112 and 113, respectively.

The first buffer section 114 may be formed between the first and second sections 111 and 112 and the second buffer section 117 may be formed between the second and third sections 112 and 113.

The sections 111, 112, and 113 correspond side walls for the respective storerooms 21, 22, and 23. The storerooms 21, 22, and 23 are separated by the partitions 50, as described above. Accordingly, the sections 111, 112, and 113 may be separated by the partitions 50 as well.

Specifically, the sections 111, 112, 113 are areas on the side wall 110, and the first and second partitions 51 and 52 may be coupled to the side wall 110 by the first and second brackets 61 and 62, respectively.

Accordingly, the first and second sections 111 and 112 are separated by the first bracket 61, and the second and third sections 112 and 113 are separated by the second bracket 62.

The first buffer section 114 may be formed at a location corresponding to the location where the first bracket 61 is coupled to the side wall 110. The first buffer section 114 may be arranged within the vertical length of the first bracket 61.

The second buffer section 117 may be formed at a location corresponding to the location where the second bracket 62 is coupled to the side wall 110. The second buffer section 117 may be arranged within the vertical length of the second bracket 62.

Accordingly, each of the buffer sections 114 and 117 may be arranged between the sections 111 and 112 or 112 or 113.

The first buffer section 114 is an area where the temperature kept on the first section 111 and the temperature kept on the second section 112 mix, containing changes in temperature in a portion of the first section 111 or the second section 112 near the first buffer section 114.

The second buffer section 117 is an area where the temperature kept on the third section 113 and the temperature kept on the second section 112 mix, containing changes in temperature in a portion of the third section 113 or the second section 112 near the second buffer section 117.

The buffer sections 114 and 117 will now be described in detail.

Figure 5:
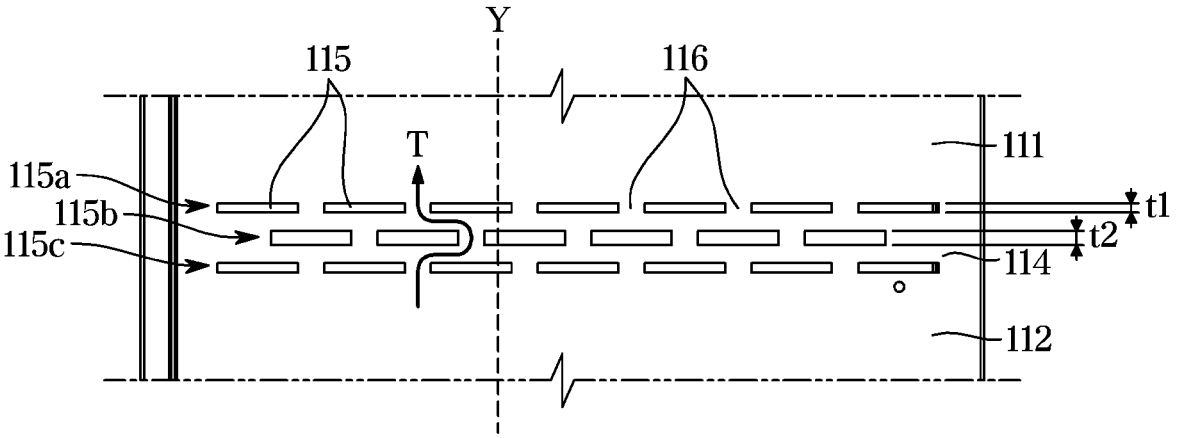
FIG. 5 shows a buffer section on an inner casing of a refrigerator, according to an embodiment of the disclosure.
Figure 6:
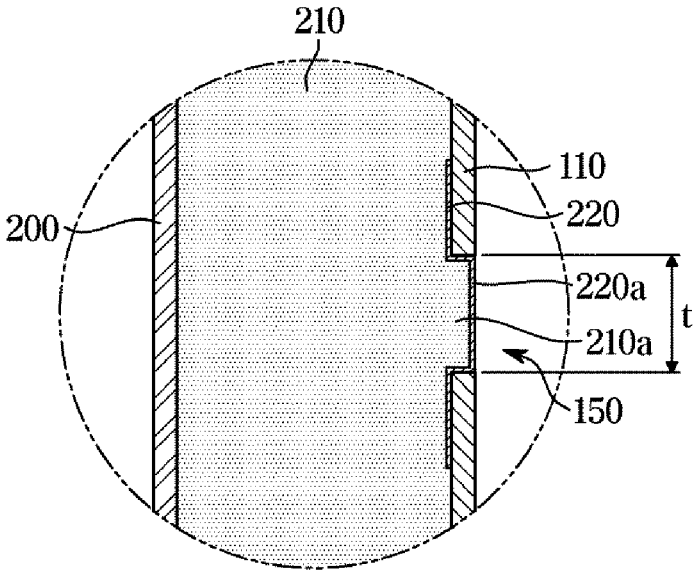
FIG. 6 is a cross-sectional view of an inner casing and an outer casing of a refrigerator, according to an embodiment of the disclosure.

FIG. 5 shows a buffer section on an inner casing of a refrigerator, according to an embodiment of the disclosure, and FIG. 6 is a cross-sectional view of an inner casing and an outer casing of a refrigerator, according to an embodiment of the disclosure.

The first buffer section 114 and the second buffer section 117 have the same configuration, so only the first buffer section 114 will be described to avoid repetitive explanation. The side wall 110 of the inner casing 100 is provided in a pair, and the pair of the side walls 110 are symmetrical. To avoid repetitive explanation, the first buffer section 114 arranged on one of the pair of the side walls 110 will be described below.

As described above, the first buffer section 114 may be arranged between the first and second sections 111 and 112. Furthermore, the first buffer section 114 is formed at a location corresponding to the location where the first bracket 61 is coupled to the side wall 110.

As described above, both a side wall of the first storeroom 21 and a side wall of the first storeroom 22 may be formed by a single stainless steel plate. Accordingly, when the first and second storerooms 21 and 22 maintain different temperatures, temperatures on the first and second sections 111 and 112 may mix in the first buffer section 114 located between the first and second sections 111 and 112 along the stainless steel plate, and the first and second sections 111 and 112 bordering with the first buffer section 114 may be influenced by the temperature shifted along the side wall 110.

In other words, the first and second storerooms 21 and 22 share the side wall 110, so that a temperature in the first storeroom 21 and a temperature on the first section 111 may be different or a temperature in the second storeroom 21 and a temperature on the second section 112 may be different.

Especially, when the first or second section 111 or 112 has the lower temperature than that of the first or second storeroom 21 or 22, dew condensation may occur on the surface of the first or second section 111 or 112.

The first buffer section 114 may contain a drop of temperature on the first section 111 near the second section 112 due to the influence of the temperature on the second section 112 when the temperature on the second section 112 is lower than that on the first section 111, and may contain a drop of temperature on the second section 112 near the first section 111 due to the influence of the temperature on the first section 111 when the temperature on the first section 111 is lower than that on the second section 112.

Assuming that the first storeroom 21 is kept at about 18 or so degrees Celsius to store red wines and the second storeroom 22 is kept at about 6 or so degrees Celsius to store white wines, the first and second sections 111 and 112 may be maintained at about 18 and about 6 degrees Celsius, respectively.

As described above, the first and second sections 111 and 112 are on the single plate, so that the temperature in a portion of the first section 111 near the second section 112 (the first buffer section 114) may drop due to the influence on the second section 112.

Specifically, in the first buffer section 114, the low temperature on the second section 112 may be shifted to the first section 111, causing a drop of temperature in a portion of the first section 111 near the first buffer section 114 and thus causing dew condensation.

To prevent this, the first buffer section 114 may include a plurality of holes 115.

The first buffer section 114 may include mid-spaces 116 between the plurality of holes 115 in the horizontal direction.

The mid-spaces 116 are spaces of the stainless steel plate between the plurality of holes 115.

Heat transfer on the side wall 110 may be done across the stainless steel plate. Specifically, the low temperature on the second section 112 may be shifted up the figure of the stainless steel plate, thus influencing the first section 111.

The heat may not be transferred to the cut space formed by the plurality of holes 115.

Accordingly, the heat may be transferred upward along the mid-spaces 116 formed between the plurality of holes 115.

With the plurality of holes 115 formed, vertical heat transfer may be made not straight but windingly along the mid-spaces 116.

Accordingly, time for the low temperature on the second section 112 to be shifted to the first section 111 may be more delayed than without the plurality of holes 115.

While the heat transfer is delayed, the first section 111 may be exposed long enough to the relatively high air supplied from the first duct 141 without being affected by low temperature.

Even when the low temperature on the second section 112 is then shifted to the first section 111, temperature on the surface of the first section 111 does not drop below a certain temperature level because the temperature on the surface of the first section 111 has risen due to the relatively high temperature air supplied from the first duct 141.

The certain temperature level may be set to a maximum temperature at which dew starts to be formed on the surface of the first section 111.

Specifically, when the low temperature on the second section 112 is rapidly shifted to the first section 111, a portion of the first section 111 adjacent to the second section 112 may go through a drop of temperature to a level close to the low temperature on the second section 112.

In this case, when the surface temperature of the portion of the first section 111 near the second section 112 drops below a certain level, dew condensation may occur on the surface of the portion of the first section 112 near the second section 112.

However, with the first buffer section 114 formed between the first and second sections 111 and 112 according to an embodiment of the disclosure, shift of the low temperature on the second section 112 to the first section 111 may be contained.

Accordingly, the surface temperature of the portion of the first section 111 near the second section 112 may be prevented from dropping below a temperature level at which the air in the first storeroom 21 starts to form dews.

Specifically, as shown in FIG. 5, at least some of the plurality of holes 115 may be arranged in a first row 115*a* at the same level in the vertical direction.

At least some of the plurality of holes 115 may be arranged in a second row 115*b* at a lower level in the vertical direction than the first row 115*a*.

Some others of the plurality of holes 115 may be arranged in a third row 115*c* at a lower level in the vertical direction than the second row 115*b*.

It is not, however, limited thereto. For example, the plurality of holes 115 may be arranged merely in the first and second rows 115*a* and 115*b*.

At least a portion of one of the holes 115 arranged in the first row 115*a* may overlap at least a portion of one of the holes 115 arranged in the second or third row 115*b* or 115*c* in the vertical direction.

For example, one of the holes 115 arranged in the first row 115*a* may overlap at least one of a hole arranged in the second row 115*b* or a hole arranged in the third row 15*c* with respect to a vertical reference axis Y.

In an embodiment of the disclosure, the first row 115*a* and the third row 115*c* may be arranged to vertically correspond to each other. Accordingly, one of the holes 115 in the first row 115*a* may vertically overlap one of the holes 115 in the third row 115*c*.

It is not, however, limited thereto, and even when the first and third rows 115*a* and 115*c* do not vertically correspond, one of the holes 115 in the first row 115*a* may vertically overlap one of the holes 115 in the second row 115*b* or the third row 115*c* with respect to the Y axis.

For example, mid-spaces 116 in the first and third rows 115*a* and 115*c* may vertically overlap the plurality of holes 115 arranged in the second row 115*b*.

In other words, the plurality of holes 115 arranged in the second row 115*b* may vertically overlap the mid-spaces 116 arranged in the first and third rows 115*a* and 115*c*.

Hence, a shift path T of the low temperature on the second section 112 to the first section 111 may be bent several times in the vertical direction.

As for vertical length t of the plurality of holes 115, vertical length t2 of the holes 115 arranged in the second row 115*b* may be larger than vertical length t1 of the holes 115 arranged in the first or third row 115*a* or 115*c*.

The larger the vertical length t of the holes 115, the more the heat transfer from the second section 112 to the first section 111 may be contained.

However, the vertical length t of the holes may not be set to be more than a certain length because the vertical length t of the holes 115 formed as being too large may degrade strength of the stainless steel plate.

By setting the vertical length t2 of the holes 115 arranged in the second row 115*b* to be larger than the vertical length t1 of the holes 115 arranged in the first or third row 115*a* or 115*c*, heat transfer on the stainless steel plate may be contained as much as possible while the strength of the stainless steel plate is preserved.

In order to further contain the shift of the low temperature on the second section 112 in the buffer section 114, the plurality of holes 115 may be filled with insulation 210.

As described above, the insulation 210 may be foamed between the inner casing 100 and the outer casing 200 in a manufacturing stage of the wine refrigerator 1. In this process, some of the insulation 210*a* foamed between the inner casing 100 and the outer casing 200 may fill in the plurality of holes 115.

A cover member 220 may be attached to the outer side of the inner casing 100, the outer side of the first buffer section 114 in particular, to prevent the insulation 210 from leaking out into the storeroom 20 through the plurality of holes 115 when the insulation 210 is being foamed.

The cover member 220 may be formed with an adhesive member such as a sticker.

Although the insulation 200 may not leak out into the storeroom 20 through the plurality of holes 115 because of the presence of the cover member 220, some of the insulation 210*a* may be foamed even into the plurality of holes 115 due to the pressure of being foamed between the inner casing 110 and the outer casing 200.

Accordingly, some of the cover member 220*a* and some of the insulation 210*a* may exist in the plurality of holes 115.

When the plurality of holes 115 are empty, the low temperature on the second section 112 may be partially shifted onto the first section 111 through the plurality of holes 115 due to heat radiation via air in the empty space of the plurality of holes 115.

In the embodiment of the disclosure, as the insulation 210*a* exists in the plurality of holes 115, heat transfer may be further contained, thereby increasing efficiency of the first buffer section 114.

A buffer section 114' of the wine refrigerator 1 according to another embodiment of the disclosure will now be described. Configurations other than the first buffer section 114' are the same as those of the wine refrigerator 1 according to the previous embodiment of the disclosure, so the overlapping description thereof will not be repeated.

Figure 7:
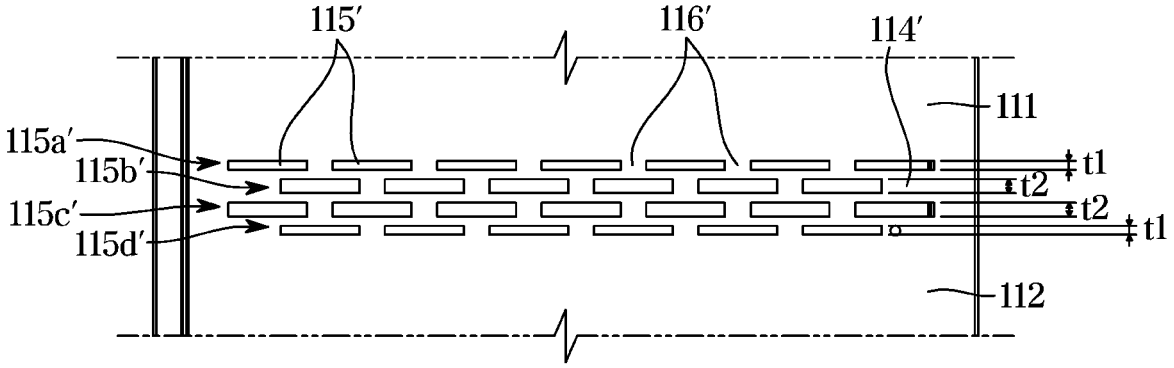
FIG. 7 shows a buffer section on an inner casing of a refrigerator, according to another embodiment of the disclosure.

FIG. 7 shows a buffer section on an inner casing of a refrigerator, according to another embodiment of the disclosure.

Specifically, referring to FIG. 7, at least some of a plurality of holes 115' may be arranged in a first row 115*a'* at the same level in the vertical direction.

At least some of the plurality of holes 115' may be arranged in a second row 115*b'* at a lower level in the vertical direction than the first row 115*a'*.

At least some of the plurality of holes 115' may be arranged in a third row 115*c'* at a lower level in the vertical direction than the second row 115*b'*.

Some others of the plurality of holes 115' may be arranged in a fourth row 115*d'* at a lower level in the vertical direction than the third row 115*c'*.

In an embodiment of the disclosure, the first row 115*a'* and the third row 115*c'* may be arranged to vertically correspond to each other. The second row 115*b'* and the fourth row 115*d'* are arranged to vertically correspond to each other.

It is not, however, limited thereto, and in another embodiment of the disclosure, the first row 115*a'* and the third row 115*c'* may not correspond in the vertical direction, but one of the holes 115' arranged in the first row 115*a'* may overlap at least one of the holes 115' arranged in the second, third, or fourth row 115*b'*, 115*c'*, or 115*d'* in the vertical direction.

For example, mid-spaces 116' in the first and third rows 115*a'* and 115*c'* may vertically overlap the plurality of holes 115' arranged in the second and fourth rows 115*b'* and 115*d'*.

Furthermore, the mid-spaces 116' in the second and fourth rows 115*b'* and 115*d'* may vertically overlap the plurality of holes 115' arranged in the first and third rows 115*a'* and 115*c'*.

As compared with the first buffer section 114 as described above in the previous embodiment of the disclosure, the first buffer section 114' according to this embodiment of the disclosure may have the shift path T of the low temperature on the second section 112 to the first section 111 formed by bending several more times in the vertical direction.

As for vertical length t of the plurality of holes 115', vertical length t2 of the holes 115' arranged in the second and third rows 115*b'* and 115*c'* may be larger than vertical length t1 of the holes 115' arranged in the first or fourth row 115*a'* or 115*d'*.

A cover member 220' of the wine refrigerator 1 according to another embodiment of the disclosure will now be described. Configurations other than the cover member 220' are the same as those of the wine refrigerator 1 according to the previous embodiment of the disclosure, so the overlapping description thereof will not be repeated.

Figure 8A:
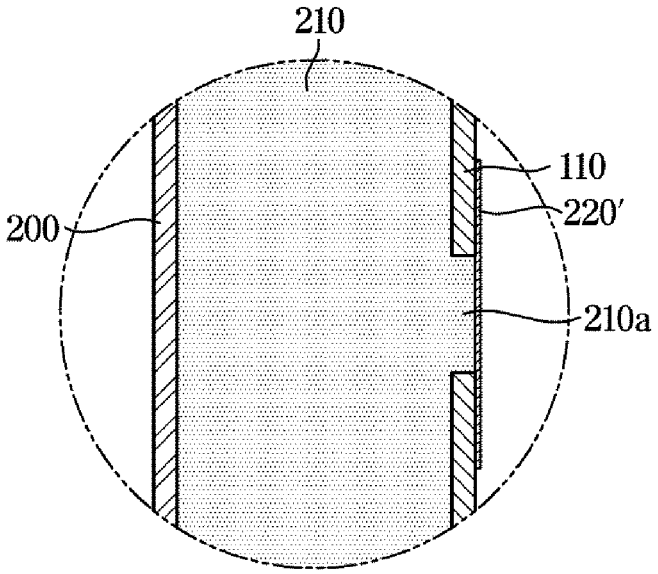
FIG. 8A is a cross-sectional view of an inner casing and an outer casing of a refrigerator, according to another embodiment of the disclosure.
Figure 8B:
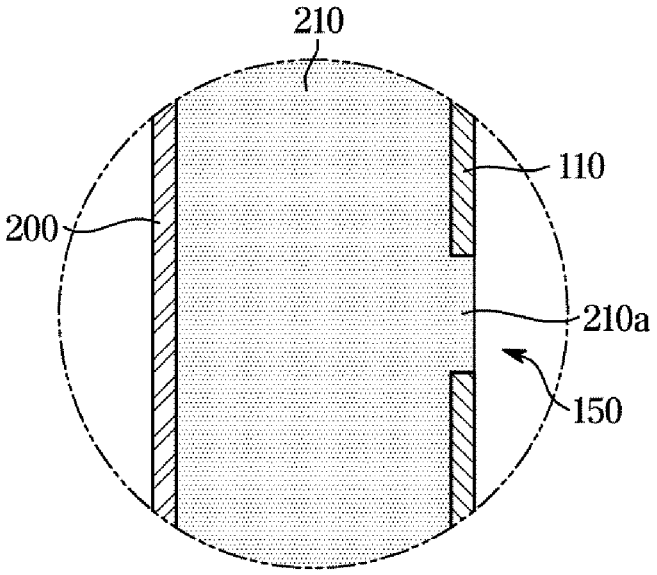
FIG. 8B is a cross-sectional view of an inner casing and an outer casing of a refrigerator, according to another embodiment of the disclosure.

FIG. 8A is a cross-sectional view of an inner casing and an outer casing of a refrigerator, according to another embodiment of the disclosure, and FIG. 8B is a cross-sectional view of an inner casing and an outer casing of a refrigerator, according to another embodiment of the disclosure.

In the previous embodiment of the disclosure, the cover member 220 of the wine refrigerator 1 is arranged on the outer side of the first buffer section 114 of the inner casing 100.

On the contrary, in this embodiment of the disclosure, the cover member 220' of the wine refrigerator 1 may be arranged on the inner side of the inner casing 100, as shown in FIG. 8A. For example, the cover member 220' may be attached onto the side wall 110 that belongs to the storeroom 20.

With the cover member 220' attached thereto, the insulation 210 may be foamed between the inner casing 100 and the outer casing 200 without leaking out into the storeroom 20 due to the presence of the cover member 220'.

After completion of foaming of the insulation 210, the cover member 220' may be removed from the inner casing 100 as shown in FIG. 8B.

After removal of the cover member 220', some of the insulation 210' may fill in a plurality of holes 150 to increase efficiency of the first buffer section 114.

An insulation member 230 of the wine refrigerator 1 according to another embodiment of the disclosure will now be described. Configurations other than the insulation member 230 are the same as those of the wine refrigerator 1 according to the previous embodiment of the disclosure, so the overlapping description thereof will not be repeated.

Figure 9:
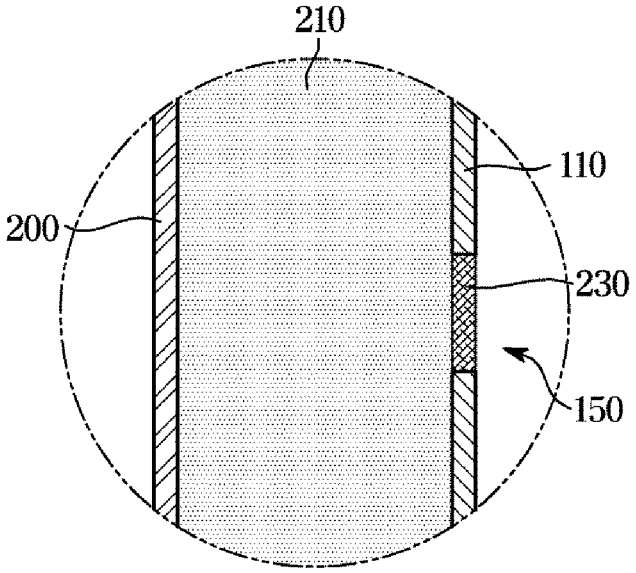
FIG. 9 is a cross-sectional view of an inner casing and an outer casing of a refrigerator, according to another embodiment of the disclosure.

FIG. 9 is a cross-sectional view of an inner casing and an outer casing of a refrigerator, according to another embodiment of the disclosure.

Referring to FIG. 9, the plurality of holes 150 of the wine refrigerator 1 may be filled with the insulation member 230 to increase efficiency of the first buffer section 114.

Some of the insulation 210*a* may be foamed into the plurality of holes 150 when the insulation 210 is foamed between the inner casing 100 and the outer casing 200 as in the previous embodiment (see FIG. 6), but the insulation member 230 having additional insulating performance may replace the insulation 210*a* in the plurality of holes 150 in this embodiment of the disclosure.

The insulation member 230 may have much better insulating performance than the insulation 210.

Hence, the shift rate of the low temperature on the second section 112 to the first section 111 may be reduced easily.

In another embodiment of the disclosure, the insulation member 230 may have insulating performance equal to or lower than that of the insulation 210.

When some of the insulation 210*a* fails to be foamed into the plurality of holes 150, the insulation member 230 may be inserted to the plurality of holes 150.

According to embodiments of the disclosure, a refrigerator includes a first plate of an inner casing forming a wall of a first storeroom and a second storeroom, the first plate having a plurality of holes formed on a border area between the first and second storerooms, thereby significantly reducing a temperature drop in a portion near the border area in the first storeroom due to movement of cold air of the second storeroom to the first storeroom along the first plate.

As indicated above, a partition, such as the partition 50, may divide the storeroom 20 in the vertical direction. In this case, as should be well understood from the above, a plurality of holes in a first row, such as the plurality of holes in the first row 115*a*, may be at a first level in the vertical direction, and a plurality of holes in a second row, such as the plurality of holes in the second row 115*b*, may be at a second level in the vertical direction.

However, as indicated above, a partition, such as the partition 50, is not limited to dividing the storeroom 20 in the vertical direction, and may be vertically installed to divide the storeroom 20 the horizontal direction. In this case, as should be well understood from the above, a plurality of holes in a first row, such as the plurality of holes in the first row 115*a*, may be at a first level in the horizontal direction, and a plurality of holes in a second row, such as the plurality of holes in the second row 115*b*, may be at a second level in the horizontal direction.

According to embodiments of the disclosure, a refrigerator prevents a temperature drop in some portion of a high temperature storeroom due to cold air produced in a storeroom maintained at low temperature flowing into the high temperature storeroom along an inner casing wall that serves as common sides of the plurality of storerooms maintained at different temperatures.

Several embodiments have been described above, but a person of ordinary skill in the art will understand and appreciate that various modifications can be made without departing the scope of the present disclosure. Thus, it will be apparent to those ordinary skilled in the art that the true scope of technical protection is only defined by the following claims.

What is claimed is:

1. A refrigerator comprising:

a storeroom;

an inner casing including a first plate to define the storeroom; and a partition coupled to the first plate to divide the storeroom into a plurality of storerooms in one of a vertical direction and a horizontal direction, wherein the first plate comprises holes formed in an area of the first plate over which the partition is coupled, a first plurality of holes of the holes formed in the area define a first row of holes at a first level in the one of the vertical direction and the horizontal direction, and a second plurality of holes of the holes formed in the area define a second row of holes at a second level in the one of the vertical direction and the horizontal direction, at least some holes of the second plurality of holes have a larger cross-section than the holes of the first plurality of holes, and the vertical direction and the horizontal direction are directions with respect to a standing upright position of the refrigerator.

2. The refrigerator of claim 1, wherein the plurality of storerooms have respective side walls aligned in a direction defined by the first plate.

3. The refrigerator of claim 1, wherein the first plate comprises a metal material.

4. The refrigerator of claim 1, wherein the inner casing comprises a second plate arranged parallel to the first plate, and the first and second plates are not connected to each other.

5. The refrigerator of claim 1, wherein the first and second rows are parallel to each other, and at least a portion of a hole of the first plurality of holes defining the first row of holes and at least a portion of a hole of the second plurality of holes defining the second row overlap each other in the one of the vertical direction and the horizontal direction.

6. The refrigerator of claim 5, wherein a third plurality of holes of the holes formed in the area define a third row of holes at a third level in the one of the vertical direction and the horizontal direction, the second row of holes is between the first row of holes and the third row of holes, and at least some holes of the second plurality of holes have a larger cross-section than the holes of the third plurality of holes.

7. The refrigerator of claim 6, wherein the first plurality of holes and the third plurality of third holes are aligned with each other in the one of the vertical direction and the horizontal direction, and the second plurality of holes overlap some of the first plurality of holes and some of the third plurality of holes in the one of the vertical direction and the horizontal direction.

8. The refrigerator of claim 6, wherein a fourth plurality of holes of the holes formed in the area define a fourth row of holes at a fourth level in the one of the vertical direction and the horizontal direction, and the second plurality of holes and the third plurality of holes are between the first plurality of holes and the fourth plurality of holes.

9. The refrigerator of claim 6, wherein:

first mid-spaces are formed in the area of the first plate in the first row between the holes of the first plurality of holes, second mid-spaces are formed in the area of the first plate in the third row between the holes of the third plurality of holes, and the holes of the second plurality of holes are aligned with the first mid-spaces and the second mid-spaces in the one of the vertical direction and the horizontal direction and are larger than the first mid-spaces and the second mid-spaces in the other of the one of the vertical direction and horizontal direction.

10. The refrigerator of claim 1, wherein:

mid-spaces are formed in the area of the first plate in the first row between the holes of the first plurality of holes, and the holes of the second plurality of holes are aligned with the mid-spaces in the one of the vertical direction and the horizontal direction and are larger than the mid-spaces in the other of the one of the vertical direction and horizontal direction.

11. The refrigerator of claim 1, further comprising:

a bracket arranged on the first plate to couple the partition to the first plate, wherein the bracket is over the area of the first plate in which the holes are formed.

12. The refrigerator of claim 1, further comprising:

an outer casing coupled onto an outer side of the inner casing to define an exterior of the refrigerator, and an insulation filling in between the inner casing and the outer casing, wherein the inner casing further comprises a cover member attached onto an outer side of the first plate to cover the holes formed in the area in order to prevent the insulation from leaking out into the storeroom through the holes formed in the area during filling of the insulation.

13. The refrigerator of claim 1, further comprising:

an outer casing coupled onto an outer side of the inner casing to define an exterior of the refrigerator, and an insulation filling in between the inner casing and the outer casing, wherein the insulation flows from outside of the inner casing to the holes formed in the area, and fills in the holes formed in the area.

14. The refrigerator of claim 1, further comprising:

an outer casing coupled onto an outer side of the inner casing to define an exterior of the refrigerator, and an insulation filling in between the inner casing and the outer casing, wherein the holes formed in the area are filled with an auxiliary insulation.

15. The refrigerator of claim 1, further comprising:

a first duct for supplying cold air produced by a first evaporator to the storeroom; and a second duct for supplying cold air produced by a second evaporator to the storeroom, wherein the partition divides the storeroom into a first storeroom corresponding to the first duct and a second storeroom corresponding to the second duct.

16. A refrigerator comprising:

a storeroom;

an inner casing comprising a first wall formed of a metal to define a first side of the storeroom, wherein the first wall includes a buffer section;

an outer casing coupled onto an outer side of the inner casing to define an exterior of the refrigerator;

an insulation filling in between the inner casing and the outer casing; and a partition coupled to the first wall, and being positioned over the buffer section, to divide the storeroom into first and second storerooms, wherein the buffer section includes a plurality of holes extending through the first wall, so that the buffer section is thereby configured to contain heat transfer from one of the first and second storerooms to the other of the first and second storerooms, the plurality of holes include a first plurality of holes defining a first row of holes at a first level in one of a vertical direction and a horizontal direction, and a second plurality of holes defining a second row of holes at a second level in the one of the vertical direction and the horizontal direction, and at least some holes of the second plurality of holes have a larger cross-section than the holes of the first plurality of holes.

17. The refrigerator of claim 16, wherein the refrigerator is configured to keep the second storeroom at a lower temperature than the first storeroom, and the plurality of holes are arranged such that a heat transfer path extends through the buffer section in a non-linear manner from a side of the buffer section adjacent to the second storeroom to a side of the buffer section adjacent to the first storeroom.

18. The refrigerator of claim 17, wherein the partition divides the storeroom into the first and second storerooms in one of a vertical and horizontal direction, the plurality of holes further include a third plurality of holes defining a third row of holes at a third level in the one of the vertical direction and the horizontal direction, so that the heat transfer path is a winding path with at least two bends, and the vertical direction and the horizontal direction are directions with respect to a standing upright position of the refrigerator.

19. A refrigerator comprising:

a plate having a buffer section; and a partition coupled to the plate, with the partition being positioned over the buffer section, to provide first and second storerooms separated by the partition with the plate being a single plate defining a wall of the first storeroom and a wall of the second storeroom, wherein the buffer section includes a plurality of holes extending through the plate, and so that the buffer section is thereby configured to contain heat transfer from one of the first and second storerooms to the other of the first and second storerooms, the plurality of holes include a first plurality of holes defining a first row of holes at a first level in one of a vertical direction and a horizontal direction, and a second plurality of holes defining a second row of holes at a second level in the one of the vertical direction and the horizontal direction, and at least some holes of the second plurality of holes have a larger cross-section than the holes of the first plurality of holes.

20. The refrigerator of claim 19, further comprising:

a bracket arranged on the buffer section to couple the partition to the plate.

* * * * *